US010267542B2

(12) United States Patent
Mahmoud et al.

(10) Patent No.: US 10,267,542 B2
(45) Date of Patent: Apr. 23, 2019

(54) WIDE SPEED RANGE HIGH-EFFICIENCY COLD CLIMATE HEAT PUMP

(71) Applicant: Carrier Corporation, Farmington, CT (US)

(72) Inventors: Ahmad M. Mahmoud, Bolton, CT (US); Parmesh Verma, South Windsor, CT (US); Thomas D. Radcliff, Vernon, CT (US); Richard G. Lord, Murfreesboro, TN (US); Jeffrey J. Nieter, Coventry, CT (US)

(73) Assignee: CARRIER CORPORATION, Farmington, CT (US)

( * ) Notice: Subject to any disclaimer, the term of this patent is extended or adjusted under 35 U.S.C. 154(b) by 391 days.

(21) Appl. No.: 15/086,500

(22) Filed: Mar. 31, 2016

(65) Prior Publication Data

US 2016/0290683 A1 Oct. 6, 2016

Related U.S. Application Data

(60) Provisional application No. 62/141,902, filed on Apr. 2, 2015.

(51) Int. Cl.
*F25B 13/00* (2006.01)
*F25B 41/04* (2006.01)
(Continued)

(52) U.S. Cl.
CPC ..... *F25B 13/00* (2013.01); *F25B 41/046* (2013.01); *F25B 43/00* (2013.01); *F25B 47/006* (2013.01);
(Continued)

(58) Field of Classification Search
CPC ..... F25B 13/00; F25B 4/046; F25B 43/00; F25B 47/006; F25B 2341/0012; F25B 2400/23; F25B 2500/31
See application file for complete search history.

(56) References Cited

U.S. PATENT DOCUMENTS 4,236,381 A 12/1980 Imral et al.
4,308,723 A * 1/1982 Ecker ..... F24D 11/0264 62/235.1

(Continued)

FOREIGN PATENT DOCUMENTS

CN 103697613 A 4/2014
CN 203586606 U 5/2014

(Continued)

*Primary Examiner* — Elizabeth J Martin
(74) *Attorney, Agent, or Firm* — Cantor Colburn LLP

(57) ABSTRACT

A heat pump system includes a refrigerant circuit, at least one variable speed compressor operating with a maximum pressure ratio of at least 5.0 and a variable speed range of at least three times (3×), a heat absorption heat exchanger, a heat rejection heat exchanger, an ejector disposed on the refrigerant circuit upstream of the compressor to extend a pressure ratio range and a volumetric flow range of the compressor in the cold climates, a separator disposed downstream of the ejector and upstream of the heat absorption heat exchanger, and at least one variable speed fan configured to move air through the heat rejection heat exchanger to provide a predefined an air discharge temperature greater than 90° F. A two-phase refrigerant is provided to an inlet of the heat absorption heat exchanger with a quality of less than or equal to 0.05.

6 Claims, 2 Drawing Sheets

(51) Int. Cl.
*F25B 43/00* (2006.01)
*F25B 47/00* (2006.01)

(52) U.S. Cl.
CPC ... *F25B 2341/0012* (2013.01); *F25B 2400/23* (2013.01); *F25B 2500/31* (2013.01)

(56) References Cited

U.S. PATENT DOCUMENTS

| | | | | |
|---|---|---|---|---|
| 5,036,676 | A | 8/1991 | Dudley | |
| 7,055,262 | B2 | 6/2006 | Goldberg et al. | |
| 7,266,959 | B2 | 9/2007 | Lewis | |
| 8,220,277 | B2 | 7/2012 | Dieckmann et al. | |
| 8,297,065 | B2 | 10/2012 | Vaisman et al. | |
| 8,766,539 | B2 | 7/2014 | Espiau et al. | |
| 2004/0261449 | A1* | 12/2004 | Memory | F25B 40/00 62/513 |
| 2008/0302118 | A1 | 12/2008 | Chen et al. | |
| 2010/0005831 | A1 | 1/2010 | Vaisman et al. | |
| 2012/0210736 | A1 | 8/2012 | Rockenfeller et al. | |
| 2012/0267564 | A1 | 10/2012 | Leck et al. | |
| 2012/0291462 | A1* | 11/2012 | Verma | F25B 40/00 62/115 |
| 2013/0327070 | A1* | 12/2013 | Rees | F25D 21/04 62/80 |
| 2014/0124699 | A1 | 5/2014 | Low | |

FOREIGN PATENT DOCUMENTS

| | | | |
|---|---|---|---|
| DE | 102012101980 | A1 | 9/2013 |
| WO | 2009053726 | A2 | 4/2009 |

* cited by examiner

WIDE SPEED RANGE HIGH-EFFICIENCY COLD CLIMATE HEAT PUMP

CROSS-REFERENCE TO RELATED APPLICATIONS

This application claims the benefit of U.S. provisional patent application Ser. No. 62/141,902, filed Apr. 2, 2015, the entire contents of which are incorporated herein by reference.

FIELD OF THE INVENTION

The subject matter disclosed herein relates to heat pump systems, and in particular to wide speed range, high-efficiency cold climate heat pump systems.

BACKGROUND

Use of cold climate heat pumps has been primarily limited by low capacity in very cold climates, and by low discharge temperatures resulting in "cold blow", a condition that occurs when the supply air temperature is warm enough to heat a room, but feels cold impinging on a person. The performance gap of some such systems in cold climates stems from a reduction in volumetric flow due to significantly reduced compressor suction density as well as reduction in compressor isentropic efficiency at higher pressure ratios.

Some known systems employ two to three scroll compressors to meet capacity and volumetric flow requirements. However, scroll compressors are fundamentally limited by their fixed volume ratio (for those without a discharge valve), or by the limited space for a single discharge port and valve (for those using a discharge valve). Further, such systems may require supplemental heating (e.g., electric or natural gas supplements) to achieve a desired thermal comfort in cold climates. Accordingly, it is desirable to provide a cold climate heat pump system with increased capacity and COP (coefficient of performance) at extremely low ambient temperatures.

BRIEF DESCRIPTION OF THE INVENTION

In one aspect, a heat pump system for cold climates is provided. The heat pump system includes a refrigerant circuit, at least one variable speed compressor operating with a maximum pressure ratio of at least 5.0 and a variable speed range of at least three times (3×), a heat absorption heat exchanger, a heat rejection heat exchanger, an ejector disposed on the refrigerant circuit upstream of the compressor to extend a pressure ratio range and a volumetric flow range of the compressor in the cold climates, a separator disposed downstream of the ejector and upstream of the heat absorption heat exchanger, and at least one variable speed fan configured to move air through the heat rejection heat exchanger to provide a predefined air discharge temperature greater than 90° F. The at least one variable speed compressor, the ejector, and the at least one variable speed fan are configured to provide a two-phase refrigerant to an inlet of the heat absorption heat exchanger with a quality of less than or equal to 0.05.

In addition to one or more of the features described above, or as an alternative, further embodiments may include: at least one of a sub-critical refrigerant utilized in the refrigerant circuit, and wherein work recovery is only active in a heating mode of the heat pump system; a sub-critical refrigerant utilized in the refrigerant circuit, and wherein work recovery is only active in a heating mode of the heat pump system; wherein the at least one compressor is operated at a four times (4×) speed range; a heat transfer loop thermally coupled to the heat rejection heat exchanger, wherein the heat transfer loop circulates a heat exchange medium to a building for thermal conditioning thereof; wherein the refrigerant circuit includes a refrigerant with a predefined temperature glide configured to elevate a discharge of the compressor; a super-hydrophobic coating disposed on the heat absorption heat exchanger, the super-hydrophobic coating configured to reduce frost formation thereon; and/or wherein the at least one variable speed fan is configured to move air through the heat rejection heat exchanger to provide an air discharge temperature greater than 95° F.

A method of assembling a heat pump system for cold climates is provided. The method includes providing a refrigerant circuit having a heat rejection heat exchanger thermally coupled to a serviced space for heating thereof, coupling at least one variable speed compressor to the refrigerant circuit, the at least one variable speed compressor operating with a maximum pressure ratio of at least 5.0 and a variable speed range of at least three times (3×), coupling a heat absorption heat exchanger to the refrigerant circuit, coupling an ejector to the refrigerant circuit upstream of the compressor to extend a pressure ratio range and a volumetric flow range of the compressor in the cold climates, and providing at least one variable speed fan configured to move air through the heat rejection heat exchanger to provide an air discharge temperature greater than 90° F. The at least one variable speed compressor, the ejector, and the at least one variable speed fan are configured to provide a two-phase refrigerant to an inlet of the heat absorption heat exchanger with a quality of less than or equal to 0.05.

In addition to one or more of the features described above, or as an alternative, further embodiments may include: at least one of providing a sub-critical refrigerant in the refrigerant circuit, and operating in a work recovery mode only during a heating mode of the heat pump system; providing a sub-critical refrigerant in the refrigerant circuit, and operating in a work recovery mode only during a heating mode of the heat pump system; determining a predefined temperature glide for a refrigerant of the refrigerant circuit, and setting the temperature glide of the refrigerant to the predefined temperature glide; disposing a super-hydrophobic coating on the heat absorption heat exchanger, the super-hydrophobic coating configured to reduce frost formation thereon; and/or wherein the at least one variable speed fan is configured to move air through the heat rejection heat exchanger to provide an air discharge temperature greater than 97° F.

BRIEF DESCRIPTION OF THE DRAWINGS

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

DETAILED DESCRIPTION OF THE INVENTION

Described herein are systems and methods for cold climate heat pumps configured to operate with increased capacity and COP at extremely low ambient temperatures. The systems include a single variable speed compressor. The system efficiency is increased by various other features such as an ejector, heat exchanger optimization, and high-efficiency fans.

Figure 1:
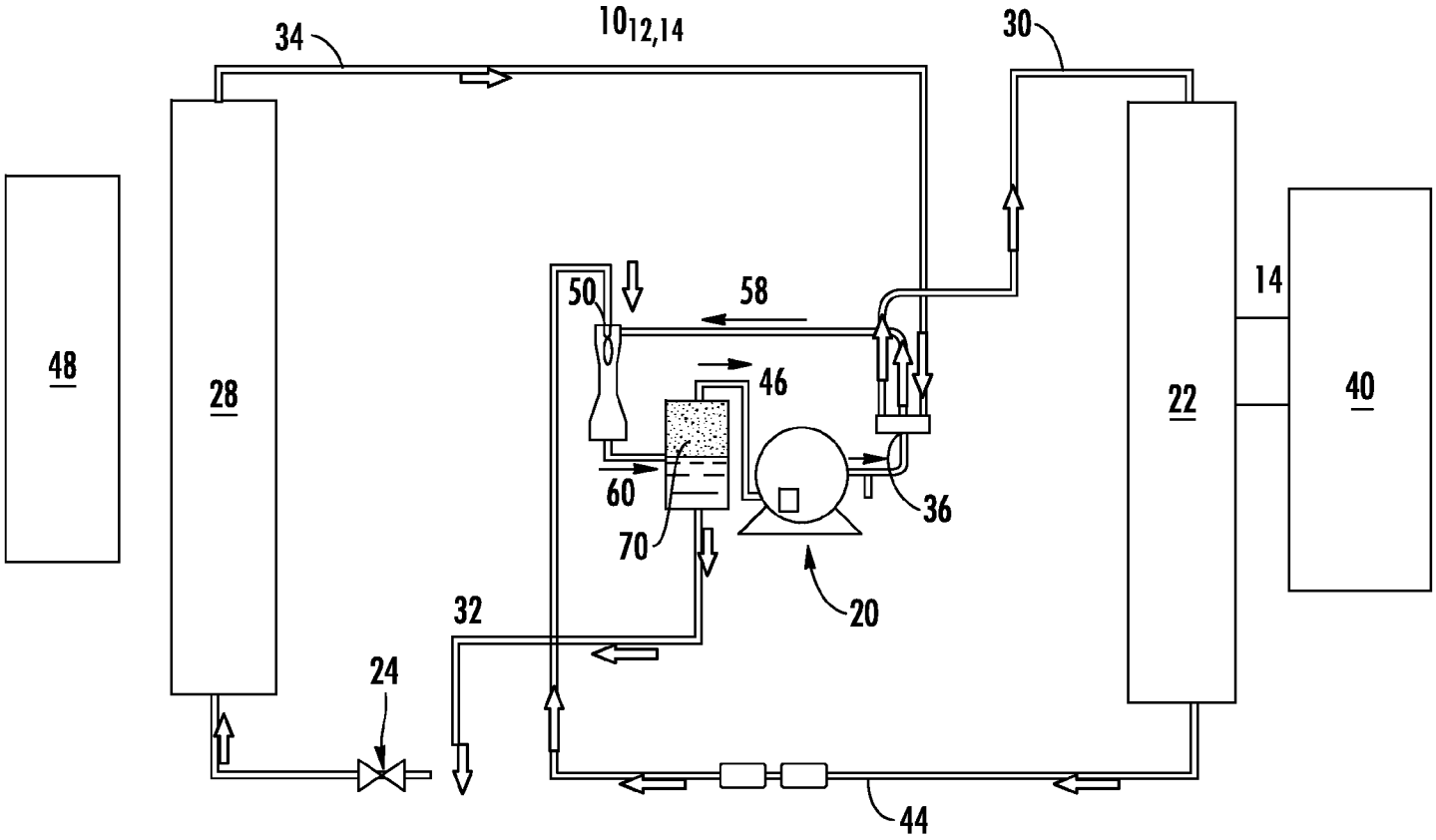
FIG. 1 is a schematic illustration of an exemplary heat pump system.

FIG. 1 illustrates an exemplary heat pump system 10 generally having a refrigerant circuit 12 for conditioning a fluid circulated in a heat transfer circuit or loop 14. In some embodiments, heat pump system 10 is an air-to-air or an air-to-water heat pump system.

Refrigerant circuit 12 generally includes a compressor 20, a heat rejection heat exchanger or condenser 22, an expansion device 24, one or more heat absorption heat exchanger or evaporator 28, a supersonic ejector 50 and a separator 70. Condenser 22 is arranged to receive high pressure refrigerant in a vapor state from compressor 20 via a discharge line 30. The refrigerant in condenser 22 is cooled using cooling water, air, or the like, in heat transfer loop 14, which carries away the heat of condensation. The refrigerant is condensed in condenser 22 and is then supplied to the supersonic ejector via a liquid line 44.

Expansion device 24 (e.g., an expansion valve) is mounted within a conduit line 32 and serves to throttle the liquid refrigerant leaving the separator 70 down to a lower pressure and to regulate the flow of refrigerant through the evaporator 28 if required to achieve further superheat of refrigerant leaving the evaporator 28 via conduit 34. In evaporator 28, the refrigerant is brought into heat transfer relationship with a heat transfer medium such as circulated outdoor ambient air. The refrigerant at the lower pressure absorbs heat from the heat transfer medium and the refrigerant is subsequently vaporized. The refrigerant vapor is then drawn from evaporator 28 via conduit 34 and through the reversing valve 36 and into the supersonic ejector 50 via conduit 58. The resultant two-phase refrigerant is then received by the liquid/vapor separator 70 via conduit 60.

In the exemplary embodiment, system 10 may include one or more controllers 100 programmed to selectively operate refrigerant circuit 12 reversibly between the cooling mode and the heating mode. As used herein, the term controller refers to an application specific integrated circuit (ASIC), an electronic circuit, a processor (shared, dedicated, or group) and memory that executes one or more software or firmware programs, a combinational logic circuit, and/or other suitable components that provide the described functionality. However, system 10 may have various other valving configurations that enable system 10 to function as described herein.

Heat transfer loop 14 exchanges thermal energy between condenser 22 and a serviced space 40 (e.g., a building). Heat transfer loop 14 includes a supply line, a return line, and a supply fan or pump (not shown) that supplies air/water warmed by condenser 22 to serviced space 40 for warming thereof. Cooled return air/water is transferred via return line where it may be directed back to condenser 22. In typical space heating applications, the heat pump system is dimensioned to provide a services space with sufficient heating capacity in some "design condition," which represents a severe but not uncommon outdoor air temperature condition.

Heat pump system 10 utilizes several features to improve cold climate capacity and performance and greatly reduce the dependence on inefficient electrical space heating system in cold climates. As such, heat pump system 10 is operable to meet serviced space heat load requirements without auxiliary heat (electrical, natural gas, etc.). The capacity increasing features of heat pump system 10 include: a high-efficiency, wide speed range compressor 20, a supersonic ejector 50 (FIG. 1), optimized heat exchangers (i.e., condenser 22 and evaporator 28), a system-level optimized refrigerant, and high-efficiency fans Compression Compressor 20 is a high-efficiency, high pressure ratio, and variable speed compressor. Compressor 20 is optimized for both heating and cooling conditions by operating over a wide range of operating speeds (e.g., 3×-4× speed range). Compressor 20 of heat pump system 10 is sized for a volumetric flow rate at an extreme heating condition necessary to optimize a value proposition of system 10. The maximum speed is chosen to be at the extreme heating condition based on the pressure ratio expected in ejector 50 to obtain maximum entrainment and efficiency from ejector 50. A minimum speed of compressor 20 is chosen such that a 3× range is developed at a moderate heating (i.e., product rating condition) such that the entrainment ratio and the efficiency of ejector 50 is only incrementally lower than at the extreme heating condition. In one embodiment, compressor 20 operates with a maximum pressure ratio of at least 5.0. Maximum pressure ratio is defined by the compressor discharge pressure divided by the compressor suction pressure.

Ejector

Supersonic ejector 50 is formed as a combination of a motive (primary) nozzle nested within an outer member or body (not shown). Ejector 50 has a motive flow inlet (primary inlet) which may form the inlet to the motive nozzle, conduit 44 in FIG. 1. An ejector outlet may be the outlet of the outer member. A motive/primary refrigerant flow enters the inlet and then passes into a convergent section of the motive nozzle. It then passes through a throat section and an expansion (divergent) section and through an outlet of the motive nozzle. The motive nozzle accelerates the flow and decreases the pressure of the flow. The ejector has a secondary inlet via conduit 58 forming an inlet of the outer member. The pressure reduction caused to the primary flow by the motive nozzle helps draw a suction flow or secondary flow into the outer member through the suction port. The outer member may include a mixer having a convergent section and an elongate throat or mixing section. The motive nozzle outlet may be positioned within the convergent section. As the motive flow exits the motive nozzle outlet, it begins to mix with the suction flow with further mixing occurring through the mixing section which provides a mixing zone.

During operation, ejector 50 is designed to provide a maximum pressure lift of the evaporator superheated suction vapor delivered via conduit 58 to an intermediate state leaving the supersonic ejector 50 via conduit 60 through entrainment with the high-pressure accelerated two-phase motive flow. It is the geometry, refrigerant condition, and flow rate of the superheated vapor and subcooled liquid motive flow that directly impacts the efficiency of ejector 50. System 10 further includes heat exchangers and fans to further influence these conditions, as described herein in more detail.

Supersonic ejector 50 serves as a simple and cost-effective pre-compressor that minimizes the pressure ratio across compressor 20 that compressor 20 must operate under as well as facilitates obtaining an optimum speed of compressor 20 to optimize performance. As such, in the exemplary embodiment, ejector 50 improves suction pressure and extends the range of the compressor in terms of pressure ratio and volumetric flow specifically for cold climate conditions.

Heat Exchanger Optimization

In the exemplary embodiment, heat exchangers 22 and 28 are optimized to provide adequate cycle conditions for the suction and motive flows to ejector 50. A combination of coil designs, headering and collection, and circuiting is required to ensure minimal pressure drop and hence optimal ejector performance.

In one embodiment, evaporator 28 is configured to receive a two-phase refrigerant with a quality less than 0.05. Two-phase refrigerant quality is the amount of refrigerant vapor relative to the total mass of refrigerant fluid, where a quality of zero is an all-liquid refrigerant and a quality of one is an all-vapor refrigerant. A separator 70 having an inlet 60, a vapor outlet 46, and a liquid outlet 32 receives two-phase refrigerant flow from supersonic ejector 50. Refrigerant is provided to evaporator 28 from the liquid outlet. The separator 70 is sized and designed in such a way that the quality of the refrigerant exiting the liquid outlet 32 is less than 0.05.

Refrigerant Selection

Heat pump system 10 is configured to receive a working fluid (i.e., a refrigerant) that operates at a pressure in condenser 22 less than the critical pressure of the refrigerant. In this way, the cycle is termed as a subcritical cycle. This refrigerant may include a single molecule (e.g., R32 difluoromethane) or may include several compounds in the form of a refrigerant mixture (e.g., R410A). The refrigerant mixture may be a perfect azeotrope, near azeotrope, or non-azeotripic in nature. Heat pump system 10 may also be configured to receive a non-azeotropic refrigerant mixture with a predefined temperature glide. Temperature glide is defined as the difference in the saturated vapor and liquid temperatures at a given pressure. In one embodiment, the refrigerant glide opens the temperature approach at an inlet of evaporator 28, thereby enabling higher compressor suction density at the same ambient temperature. In addition, the refrigerant glide can elevate the compressor discharge temperature slightly, which facilitates reducing the impact of cold blow.

High Efficiency Fans

Figure 2:
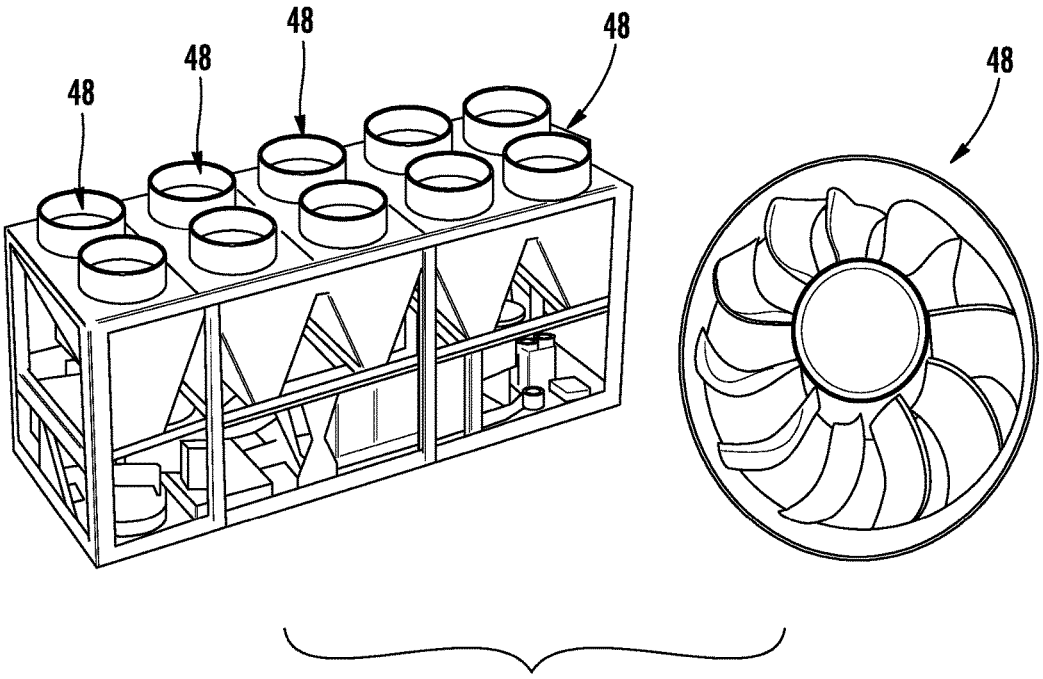
FIG. 2 is a perspective view of an exemplary high efficiency fan that may be used with the system shown in FIG. 1.

Current heat pump technology typically uses single speed, standard-efficiency fans that provide limited operational benefit and flexibility to supersonic ejector 50. In the exemplary embodiment, in order to maximize full-load and part-load performance, heat pump system 10 is provided with one or more variable speed, high-efficiency fans 48, 40 (FIG. 1) configured to move air through condenser 22 and evaporator 28 to maintain compressor 20 suction and discharge pressures necessary for the intended operation of supersonic ejector 50. High-efficiency fan(s) 48 include high-efficiency ECM fan motors, fan blades, and shrouds. For example, as shown in FIG. 2, fan(s) 48 include a high-efficiency aero-acoustic condenser fan system with integrated shroud and multi-fan blades. As such, high-efficiency, quiet fan(s) 48 enhance air-side thermal-hydraulic performance of heat exchangers 22, 28.

Described herein are systems and methods for cold climate heat pumps configured to operate with increased capacity and COP at extremely low ambient temperatures. The systems includes at least one single variable speed compressor, a supersonic ejector, heat exchanger optimization, working fluid mixtures, and high-efficiency fans. For example, the use of reciprocating compressors may extend the range of pressure ratios the compressors can be efficient over, and the ejector and heat exchanger optimization shrink the range of pressures the compressors have to address. As such, the systems provide variable speed and the ability to deliver high efficiency over a large range of pressure ratios at ambient temperatures below 5° F., below 0° F., or even below −10° F.

Example Comparison

Heat pump system 10 provides significant efficiency improvement at low temperatures over that of some known heat pump systems. Many known heat pumps employ fixed or variable speed scroll compressors. Scroll compressors are fundamentally limited by their fixed volume ratio (for those without a discharge valve), or by the limited space for a single discharge port and valve (for those using a discharge valve). In comparison, a wide range compressor in conjunction with a supersonic ejector provides consistently sustained performance across a broad range of pressure ratios, which is especially important for efficiency at the high-lift conditions prevalent in cold climate heating applications.

For example, in lower tier heat pump systems, fixed speed scroll technology is typically employed. Scroll compressors can achieve higher peak isentropic efficiencies at pressure ratios lower than approximately 3.5. However, at very aggressive cold climate conditions, which impose low suction density and high pressure ratios, scroll compressors will have lower isentropic efficiencies and will have to run at high speeds, which necessitates the use of multiple fixed or variable speed scrolls in tandem to achieve and sustain desired heating performance in cold climates.

Higher tier heat pump systems may employ variable speed scroll compressors. However, reciprocating compressors exhibit higher and flatter isentropic efficiencies at the higher end of the speed range necessary to maintain heating capacity in cold climate applications. As such, the integrated performance of compressor 20 and ejector 50 in system 10 is improved compared to scroll compressors under cold ambient conditions where high speed and high pressure ratios are required, with little effect on cooling performance in more moderate conditions where low speed is required.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A heat pump system for cold climates comprising:

a refrigerant circuit;

at least one variable speed, reciprocating compressor operating with a maximum pressure ratio of at least 5.0 and a variable speed range;

a heat absorption heat exchanger;

a heat rejection heat exchanger;

an ejector disposed on the refrigerant circuit upstream of the compressor to extend a pressure ratio range and a volumetric flow range of the compressor in the cold climates;

a separator disposed downstream of the ejector and upstream of the heat absorption heat exchanger; and at least one variable speed fan configured to move air through the heat rejection heat exchanger to provide a predefined air discharge temperature greater than 90° F., wherein the at least one variable speed compressor, the ejector, and the at least one variable speed fan are configured to provide a two-phase refrigerant to an inlet of the heat absorption heat exchanger with a quality of less than or equal to 0.05.

2. The heat pump system of claim 1, further comprising a sub-critical refrigerant utilized in the refrigerant circuit.

3. The heat pump system of claim 1, further comprising a heat transfer loop thermally coupled to the heat rejection heat exchanger, wherein the heat transfer loop circulates a heat exchange medium to a building for thermal conditioning thereof.

4. The heat pump system of claim 1, wherein the refrigerant circuit includes a refrigerant with a predefined temperature glide configured to elevate a discharge temperature of the compressor, wherein the temperature glide is defined as the difference in the saturated vapor and liquid temperatures of the refrigerant at a given pressure.

5. The heat pump system of claim 1, further comprising a super-hydrophobic coating disposed on the heat absorption heat exchanger, the super-hydrophobic coating configured to reduce frost formation thereon.

6. The heat pump system of claim 1, wherein the at least one variable speed fan is configured to move air through the heat rejection heat exchanger to provide an air discharge temperature greater than 95° F.

* * * * *